US005326944A

United States Patent [19]

Garcia

[11] Patent Number: 5,326,944

[45] Date of Patent: Jul. 5, 1994

[54] TEASE-PROOF ROTARY SWITCH

[75] Inventor: Ricardo L. Garcia, Fountain Valley, Calif.

[73] Assignee: Cole Instrument Corp., Santa Ana, Calif.

[21] Appl. No.: 887,325

[22] Filed: May 22, 1992

[51] Int. Cl.[5] ..... H01H 21/76; H01H 5/00

[52] U.S. Cl. ..... 200/11 R; 200/17 R; 200/336

[58] Field of Search ..... 200/11 R, 11 TC, 17 R, 200/17 B, 18, 400, 14, 336

[56] References Cited

U.S. PATENT DOCUMENTS 1,125,815 1/1915 Cheney ..... 200/17 B
2,769,874 11/1956 Coggeshall et al. ..... 200/400 X
3,790,731 2/1974 Date ..... 200/426
4,554,420 11/1985 Golub ..... 200/11 TC
4,910,364 3/1990 Garcia ..... 200/11 A

*Primary Examiner*—J. R. Scott
*Attorney, Agent, or Firm*—Marvin H. Kleinberg

[57] ABSTRACT

A tease-proof rotary switch has a driving shaft which is coupled to a driven shaft through a coupling spring. The driven shaft is connected to a rotating switch assembly. The driving shaft rotates, storing energy in the spring which, in turn, can rotate the driven shaft. The energy stored in the spring may be sufficient to start the rotation of the switch and to seat it in the next stable switch position. Alternatively, the driving shaft can engage an element of the driven shaft to start the rotation which can then be completed to the next stable position by the energy stored in the spring.

10 Claims, 1 Drawing Sheet

-10-
14
26
28
12
62
66
64
60
58
70
16
20
22
18
24
48
52
56
54
50
44
42
41
33
38
36
37
46
30
32
34

TEASE-PROOF ROTARY SWITCH

BACKGROUND OF THE INVENTION

The present invention relates to rotary switches and, more particularly, to an improved rotary electrical switch which is "tease-proof", which maintains a reliable electrical connection unaffected by slight rotations of the torsion shaft, and which makes only discrete circuit position changes.

1. Review of the Prior Art

Rotary switches are the product of a mature technology, yet are still the most reliable way to control multi-circuit functions in various voltage and current applications. Such switches are operated through the rotational action of a torsion shaft. Depending on the design of the internal detents, the shaft may rotate through a 360 degree range, or any portion thereof. Further, the shaft may rotate in either direction (clockwise or counterclockwise) and may be capable of unlimited rotation in a chosen direction. A more complete survey and description of the possible variations in the rotary switch is describe more fully in Garcia, Pat. No. 4,910,364, assigned to the assignee of the present invention, and which is incorporated herein by reference.

Rotary switches are designed to complete a circuit between source and target terminals, both of which are radially spaced on the outer periphery of the rotary switch encasement. This is accomplished by means of a common conductor, which is rotated by a torsion shaft, coming in contact with the conductive inner surface areas of the terminals. E.g., Garcia, infra. In most applications, it is desirable that a closed, or completed, circuit position be provided at all times and that no circuit be interrupted. Therefore, even though an interrupted circuit can exist between each closed circuit position, such a state is undesirable.

Each switch can be custom tailored to accommodate a variety of different requirements. Some applications might require switch designs which provide few circuit combinations, which in turn permits a relatively large space between the connector terminals. This could result in the creation of large open circuit positions interposed between the closed circuit positions. If the operator fails to rotate the knob sufficiently, integral switching from the first to next position might not occur, leaving the common connector in an open circuit position. The operator may then not realize that the circuit is open.

Conversely, a switch may have fine spaces between the different switch positions, so that even the slightest rotations, even unintended or unavoidable rotations ("teasing"), of the torsion shaft, may result in the common conductor's "jumping circuit", or moving to a different contact point and supplying voltage or current to an unintended set of terminals. This greatly impedes the switch's reliability and commercial usefulness.

Finally, in either scenario, slight torsional movement, or "teasing," may result in the common conductor stopping between contacts and remaining in an open circuit position, with no mechanism for preventing or correcting this event when it happens.

2. Summary of the Invention

The present invention provides a mechanism for first preventing the "teasing" of the rotary switch into unintended open circuit positions, or worse, completing the wrong circuit. Second, the same mechanism works to ensure that once the common conductor is rotated into a "between circuit position", the rotation will continue until the common conductor is locked into the intended, next circuit position. These improvements over the prior art allow the present invention to provide for a much more reliable rotary switch than was hitherto possible.

This is accomplished by decoupling the driving shaft connected to a knob, or other rotational means, from the driven shaft, and coupling them through a strong spring. The driving and driven members are able to rotate independently of each other within a predetermined range. The driving shaft can be rotated in either a clockwise or counterclockwise direction before it engages the driven shaft, thus preventing the breaking of a given circuit connection by "teasing" of the knob or other rotational means.

In one embodiment, a torsion spring is interposed between the driving and driven shafts which becomes compressed whenever the driving shaft is rotated relative to the driven shaft. Thus, whenever the driving shaft turns through its "free rotation" segment, the torsion spring concomitantly exerts an increasing force to the driven shaft. The tension that builds up within the torsion spring ensures that the common conductor, which is connected to the driven shaft, completes its full intended rotational course once it is dislodged from a given detented circuit position As a result, the common conductor does not dwell at any open circuit conductor between closed circuit positions, thus ensuring integral, discrete switching from position to position.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DESCRIPTION OF THE PREFERRED EMBODIMENTS

Figures 1, 2, 3, 4, 5:
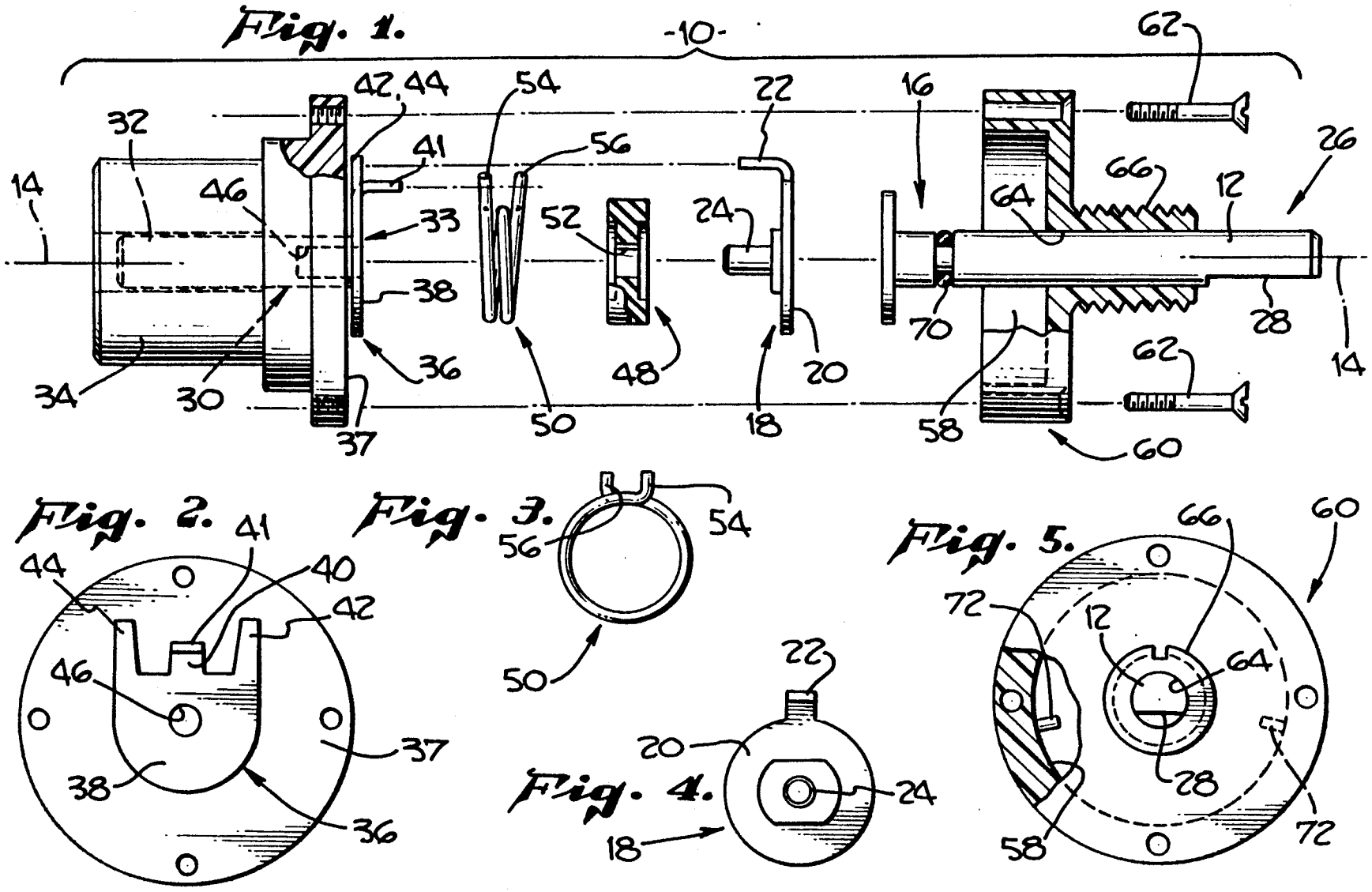
FIG. 1 is an exploded two-dimensional side view of the tease-proof rotary switch of the present invention.
FIG. 2 is a frontal view of the driven arm and fingers of the driven shaft laying flush with the face of the rotary switch body.
FIG. 3 is a frontal view of the torsion spring.
FIG. 4 is a frontal view of the driving arm.
FIG. 5 is a top view of the mechanism housing.

A preferred embodiment of the invention is shown in FIGS. 1 through 4. The tease-proof rotary switch assembly 10 has a driving shaft 12 with a longitudinal axis 14. The driving shaft 12 has at a first end 16 a driving arm assembly 18, consisting of a driving disc 20, which is perpendicular to the driving shaft 12, and a driving arm 22, which projects above the driving disc 20 and is bent forward at generally a 90 degree angle. A coupling shaft 24 protrudes from the first end 16 of the driving shaft 12 along the longitudinal axis 14. The bent over portion of the driving arm 22, which will hereinafter be referred to simply as the "driving arm", projects forward in the same direction as the coupling shaft 24 along a line that is generally parallel to the longitudinal axis 14. The driving shaft 12 has its other, second end 26, a keyway 28 to allow a knob, or other rotating means, to be secured to the driving shaft 12, for example, by means of a set screw.

A driven shaft 30, which also lies along the longitudinal axis 14, carries the common conductor 32 within a switch assembly 34. The common conductor 32 relays electrical impulses or current between a variety of circuit positions, each usually separated by a closed circuit position. A system of springs and detents urges the common conductor to reside in any of the desired closed circuit positions, as more fully described in Garcia, infra.

At the driven end 33 of the driven shaft 30, which protrudes from the switch assembly 34, is a driven arm assembly 36, which is adjacent to the planar end surface 37 of the rotation switch assembly 34, as shown in FIGS. 1 and 2. The driven arm assembly 36 consists of a driven disc 38, which is perpendicular to the longitudinal axis 14, a driven arm 40, which projects above the driven disc and which has a bent over portion 41 which bends forward at generally a 90 degree angle, and first and second driven fingers 42, 44. The driven fingers 42, 44 project from the driven disc 38 and are generally parallel to, and displaced equally on either side of, the non-bent over portion of the driven arm 40. The bent over portion 41 of the driven arm 40 extends forward along a line generally parallel to the longitudinal axis 14.

Within the driven end 33 of the driven shaft 30 is a coupling recess 46. The driving shaft 12 is slidably and rotatably connected to the driven shaft 30 by means of the coupling shaft 24, which is made to fit into the coupling recess 46. Interposed between the driving arm and driven arm assemblies 18, 36 are a washer/spacer 48 nearest the driving shaft 12, and a driving torsional spring 50 nearest the driven shaft 30. The washer/-spacer 48 has an axial recess 52 through which the coupling shaft 24 of the driven arm 12 passes.

The driving arm 22 and bent over portion 41 are adapted so that the driving arm 22 is displaced radially from bent over portion 41, there being only a narrow gap separating the two, when the driving shaft 12 is rotated relative to the driven shaft 30. The driven fingers 42, 44 form the outer boundaries of free rotation of the driving arm 22, and are of sufficient height to enclose the circular sweep of the driving arm 22. The angular position of the fingers 42, 44 relative to the driven arm 40 is tailored in accordance to the degree the switching assembly must rotate before resting in a detent position. For example, if the closed circuit detent positions are ninety degrees apart, each finger will be displaced from the center of the arm 40 by (90 degrees/2)−3=42 degrees. If the detent positions are 30 degrees apart, then each finger will be (30 degrees/2)−3=12 degrees from the arm 40.

Starting from a position directly above the bent over portion 41, the driving arm 22 may be rotationally displaced a given, and equal, amount in either a clockwise or counterclockwise direction before engaging the driven fingers 42, 44 of the driven arm assembly 36, depending upon the angular separation of successive switch positions. This "play", or restricted free movement of the driving shaft assembly 18, protects, the common conductor 32 within the switch assembly 34 from either jumping circuit or being moved to an open circuit position by small, inadvertent movements of the knob or other rotation means. As the driving arm 22 engages either of the driven fingers 42, 44, the driven shaft 30 is driven in the same rotational direction as the driving shaft 12.

Alternatively, it is possible to select a driving torsional spring 50 possessing sufficient torque that the driving arm 22 does not necessarily engage the first driven finger 42 before the switching action is accomplished. In that embodiment, the function of the fingers 42,44 may be to prevent overshooting the desired position or, to assist in positive disengagement of the detent should any foreign contaminant or other condition hinder disengagement by virtue of the spring torque action alone.

The washer/spacer 48 must be of sufficient thickness to maintain a space between the driving arm 22 and the planar end surface 37 of the switch assembly 34, as well as a space between the bent over portion 41 and the driving disc 20. However, it must not be too thick to permit the driving arm 22 from reliably engaging the driven fingers 42, 44 of the driven arm assembly 36.

The driving torsional spring 50 is generally circular, the ends of which are bent to form first and second spring levers 54, 56. The spring levers 54, 56 extend radially from the driving torsional spring 50, and are located in the same relative position along the circumference of the driving torsional spring 50 when the driving torsional spring 50 is at rest. The spring levers 54, 56 are spread open to accept between them the driving arm 22 and the bent over portion 41, thus compressing the spring 50 somewhat, even before rotation of the driving arm 22 relative to the driven arm 40. The spring levers 54, 56 must be of sufficient length to reliably engage the driving arm 22, which rides above the bent over portion 41 as explained above.

Thus, as the driving arm 22 is rotated in a clockwise direction by some outside force, it engages the first spring lever 54, turning it in a clockwise direction and further compressing the driving torsional spring 50. As the first spring lever 54 is driven clockwise, the second spring lever 56 applies an increasing force in the same direction to the driven arm 40, thus urging the driven shaft 30, along with the common conductor 32, to also rotate in a clockwise direction. However, the force of the second spring lever 56 may not be great enough to actually cause the common conductor 32 to rotate and switch out of any given circuit position Accordingly, switching action may be accomplished through the direct force of the driving arm 22 on the first driven finger 42 which, in turn, drives the driven shaft 30 and, hence, the common conductor 32.

Nevertheless, once the common conductor 32 is rotated from a detented position into an open circuit position, it will continue to rotate until it engages the next detented circuit position, even if no more rotational force is applied to the driving shaft 12 at this point in time. This is accomplished by the force of the compressed driving torsional spring 50 acting on the second spring lever 56, which in turn drives the driven arm 40 in a clockwise direction.

After the common conductor 32 is rotated into the desired circuit position, whatever lateral displacement that remains between the driving and arm 22 and bent over portion 41 will be eliminated by the spring levers 54, 56, which are forced back together by the remaining force within the driving torsional spring 50. This causes the knob, or other driving means, to be "centered". That is, the force of the compressed driving torsional spring 50 will bring the driving arm 22 back into a position directly above the bent over portion 41.

The driving and driven shaft assemblies 18, 36, along with the driving torsional spring 50 and washer/spacer 48, are enclosed within the central recess 58 of the mechanism housing 60, which is rigidly connected to the switch assembly 34. This connection is preferably made by means of two or more lug bolts 62 passing through corresponding threaded holes within the outer shell of the switch assembly 34. However, any bonding means known in the art, such as gluing or welding, would be within the purview of the disclosed invention. In this way, the driving and driven shaft assemblies 18, 36 are held together in reliable engagement.

The mechanism housing 60 contains a central aperture 64 along the longitudinal axis 14 through which the second end 26 of the driving shaft 12 fits. The mechanism housing 60 also contains a threaded mounting shaft 66 extending outward, having the same central aperture 64 as the mechanism housing 60, and also enclosing a portion of the second end 26 of the driving shaft 12. The threaded shaft 66 can be used to releasably attach a rotation means to the driving shaft 12. Enough of the second end 26 and keyway 28 must be exposed beyond the threaded shaft 66 to allow a reliable connection between the second end 26 of the driving shaft 12 and a knob or other rotation means.

In order to keep the tease-proof rotary switch assembly 10 free from moisture, chemical solvents, or other foreign materials, the driving shaft 12 contains at the first end 16 an annular groove 68 into which an O-ring seal 70 fits. The O-ring seal 70 thus provides a bushing between the driving shaft 12 and the inner wall formed by the central aperture 64 of the mechanism housing 60.

Finally, some rotary switch applications might require that the common conductor 32 only be permitted to rotate within certain predetermined rotational limits. In order to reign in the rotational sweep of the driving and driven shafts 12, 30, pins 72 can be mounted within the central recess 58 of the mechanism housing 60. The pins 72 act as stops by limiting the displacement of the driven fingers 42, 44. In this way, the common conductor 32 will not rotate into forbidden regions, or make any unwanted circuit connections.

Other variations and modifications will occur to those skilled in the art. Accordingly, the present invention should be limited only by the scope of the claims appended hereto.

What I claim is:

1. A tease-proof rotary switch assembly comprising:

a rotary switch assembly which rotates about a central longitudinal axis and which includes a plurality of closed circuit positions at discrete intervals in a rotational arc about the axis, each successive closed circuit position being separated by some rotational arc during which the circuit is open;

a driving member, including a driving arm, capable of rotational motion about said central longitudinal axis and adapted to be coupled to said rotary switch assembly by a spring member;

a driven member, including a driven arm, capable of rotational motion about said central longitudinal axis, connected to said rotary switch assembly;

said spring member, capable of rotational motion about said central longitudinal axis, interposed between said driving and driven members and coupled thereto, said spring member engaging said driving member arm and said driven member arm;

said driving member arm being capable of being rotationally displaced a predetermined amount in either rotational direction before said spring member urges, through contact with the driven arm, said driven member to rotate said switch assembly to the next closed circuit position in the rotational arc through stored internal energy imparted to said spring member by the rotation of said driving member, whereby integral switching from one closed circuit position to the next successive closed circuit position is assured.

2. The tease-proof rotary switch in claim 1 wherein said driven arm has one finger and wherein said finger is positioned to be engaged by said driving arm to initiate rotation of said driven member in the desired direction;

said spring member further including two levers projecting radially from the longitudinal axis, which are forcefully spread slightly, thereby putting said spring member into a sufficiently biased position to engage opposite sides of said driven arm;

whereby, through rotation of said driving arm, and the concomitant exertion of said spring member on said driven member through the engagement of said lever with said driven arm, said driven member rotates in the desired direction.

3. The tease-proof rotary switch in claim 1 where said driven member has 2 fingers, said fingers being symmetrically displaced from said driven arm and wherein said fingers are positioned to be engaged by said driving arm to initiate rotation of said driven member in the desired direction.

4. The tease-proof rotary switch assembly according to claim 1 wherein said driven member has first and second fingers extending radially outward for engaging said driving arm of said driving member as it rotates in either rotational direction.

5. The tease-proof rotary switch as in claim 4 wherein said fingers are angularly separated by the same angular separation as successive closed circuit switch positions.

6. Tease-proof rotary switch according to claim 1 wherein said driven arm extends in the direction of said driving member, said spring member having a first arm engaged by said driving arm and a second arm engaging said driven arm, whereby rotation of said driven arm against said first arm causes said second arm to rotate said driven arm by exerting a force on said driven arm in the same rotational direction of said driving arm.

7. The tease-proof rotary switch according to claim 1 further including a washer/spacer interposed between said driving and driven member assemblies, having a predetermined thickness to maintain a desired spacing between said driving member and said driven member, and having an axial recess through which an axial portion of said driving member passes.

8. A tease-proof rotary switch assembly comprising:

a rotary switch assembly, including rotating switching means having two or more closed circuit positions, successive closed circuit positions being separated by an open circuit position, said rotary switch assembly having a central longitudinal axis;

a driving torsion shaft located along said longitudinal axis;

a driven torsion shaft located along said longitudinal axis coupled to said rotating switching means;

a torsion spring interposed between said driving and driven torsion shafts;

said driving and driven shafts each including arm means for respectively coupling to said torsion spring, to exert a force on said driven shaft in response to rotation of said driving shaft;

said driven shaft including a first cooperating finger element permitting said driving shaft to be rotationally displaced a predetermined amount before said driving shaft engages said first finger element, the rotational displacement of said driving shaft and the tension of said torsion spring being chosen such that said rotating switching means and said driven shaft remain in a closed circuit position until said first finger element is engaged by said driving shaft arm means, said torsion spring acquiring sufficient stored internal energy from the rotation of said driving shaft to impart a driving force to said driven shaft arm means to ensure an integral switching of said rotating switching means from one closed circuit position to the next closed circuit position.

9. The tease-proof rotary switch as in claim 8 wherein said driven member has a second finger element for engaging said driving arm as it rotates toward said second finger element.

10. The tease-proof rotary switch as in claim 9 wherein said first and second finger elements are separated by the same angular separation as successive closed circuit switch positions of said rotating switching means.

* * * * *